United States Patent [19]

Suzuki et al.

[11] 4,442,034

[45] Apr. 10, 1984

[54] PROCESS FOR PRODUCING CORN OIL

[75] Inventors: Hirohisa Suzuki; Hironiro Takahashi, both of Kamakura, Japan

[73] Assignee: Ajinomoto Co., Inc., Tokyo, Japan

[21] Appl. No.: 250,729

[22] Filed: Apr. 3, 1981

[30] Foreign Application Priority Data

Apr. 17, 1980 [JP] Japan ..... 55-50999
Apr. 17, 1980 [JP] Japan ..... 55-51000

[51] Int. Cl.[3] ..... C11B 9/00; C11B 1/10
[52] U.S. Cl. ..... 260/236.6; 260/412.4
[58] Field of Search ..... 260/236.5, 412.2

[56] References Cited

U.S. PATENT DOCUMENTS 3,432,529 3/1969 Depmer ..... 260/412.4
4,008,210 2/1977 Steele et al. ..... 260/412.4
4,246,184 1/1981 Pressick et al. ..... 260/412.4
4,277,411 7/1981 Yahl ..... 260/412.4

*Primary Examiner*—Albert T. Meyers
*Assistant Examiner*—John W. Rollins
*Attorney, Agent, or Firm*—Oblon, Fisher, Spivak, McClelland & Maier

[57] ABSTRACT

Corn oil is produced by several process modifications in which maize is initially milled, the higher oil-content germ is separated from the lower oil-content germ, and then the lower oil content germ is pelletized. Thereafter, the processes vary with regard to mixing, heating and flaking the different oil-content germ fractions prior to a final step in which a mixed flaked product is extracted to remove corn oil therefrom.

6 Claims, No Drawings

PROCESS FOR PRODUCING CORN OIL

BACKGROUND OF THE INVENTION

1. Field of the Invention

The present invention relates to a process for producing corn oil.

2. Description of the Prior Art

In the drymilling of maize the germ portion of the kernel is obtained as a by-product. Because the germ contains several materials including powdered starch, the mesh of filters becomes blocked when the miscella, which contains corn oil, is filtered. To prevent the blocking of the filter mesh, the germ is casually pelletized and then extracted. That is, the customary process for producing corn oil involves the tempering of cleaned maize by adding water in an amount of from 3 weight percent to 8 weight percent to the maize, milling the tempered maize, separating the germ fraction from the by-products which are obtained after separating the grits and other material, drying the germ portion, flaking and pelletizing the dried germ, and extracting corn oil from the pellets. However, this technique has the following drawbacks. The quality of the corn oil deteriorates when heated during drying. The oil extraction yield from the pellets is not high and the extraction of flakes during filtering results in blockage of the filter mesh because of the substantial amount of fines in the material being filtered. Moreover, the germ is not a good material from which to extract corn oil. A need, therefore, continues to exist for an improved technique of extracting corn oil from maize.

SUMMARY OF THE INVENTION

Accordingly, one object of the present invention is to provide a process for producing corn oil of good quality.

Another object of the present invention is to increase the extraction efficiency of corn oil from maize.

Briefly, these objects and other objects of the invention as hereinafter will become more readily apparent can be attained by providing a process for producing corn oil which comprises (a) milling maize, (b) separating the higher oil-content germ and the lower oil-content germ each having a specified oil content, (c) pelletizing the lower oil-content germ, (d) mixing the pelletized germ with the higher oil-content germ, (e) heating and flaking the mixed germ thereby obtaining a flaked material, and (f) contacting the flakes with an organic solvent thereby extracting corn oil.

An alternative technique comprises (a) milling maize, (b) separating the higher oil-content germ and the lower oil-content germ, each having a specified oil content, (c) pelletizing and heating the lower oil-content germ, (d) heating the higher oil-content germ, (e) mixing the heated lower oil-content germ with the heated higher oil-content germ, (f) flaking the mixed germ, and (g) contacting the flakes with an organic solvent thereby extracting corn oil.

Still another alternative technique comrises (a) milling maize, (b) separating the higher oil-content germ and the lower oil-content germ, each having a specified oil content, (c) pelletizing, heating and flaking the lower oil-content germ thereby obtaining lower oil-content flakes, (d) heating and flaking the higher oil-content germ thereby obtaining higher oil-content flakes, and (e) mixing and contacting said flaked material with an organic solvent thereby extracting corn oil.

DETAILED DESCRIPTION OF THE PREFERRED EMBODIMENTS

The germ used in the process of the present invention is obtained by the dry milling of maize. The germ generally contains oil in the range from 6% to 30%. The concrete dry milling method involves the tempering of cleaned maize by adding water to the maize, and milling the tempered maize to separate the germ from the maize. The tempering conditions can be changed as a function of the property of the maize, the property and the yield of the germ and the equipment used for milling. The milling method is performed with an impact-degerminator which mills the maize to a diameter of not over 10 mm. From the milled germ, the higher oil-content fraction and the lower oil-content germ fraction are separated at a specified oil content, preferably not less than 22%. To effect the separation general methods of separation may be utilized. Especially useful separations are a plan sifter, an aspirator and a gravity separator.

The higher oil-content germ fraction remains as a batch of large and hard particles when the maize is milled. Accordingly, the higher oil-content germ fraction can be easily obtained by any one of the above separation techniques or by combinations of two or more suitably compatible separation techniques. For example, in a first step the milled maise is separated into portions varying by particle size by a plan sifter. In a second step each portion is treated by an aspirator in order to remove the husks. In the third step the germ portion, the grits and the flour portion are respectively separated by a gravity separator. The comparatively larger germ portion, if necessary, is rolled with a reduction roller and sieved with a plan sifter to remove the remaining materials, so that the higher oil-content germ portion, other germ portions and the meal portion are obtained. The other germ portions exclusive of the higher oil-content germ are added to the lower oil-content germ portions.

The higher oil-content germ portion is heated at a temperature in the range from 60° C. to 90° C. for 30 minutes to 60 minutes for softening. If the heating temperature is more than 90° C. or the heating time is more than 60 minutes, the flakes obtained are brittle, and the quality of the oil is not good. On the other hand, if the heating temperature is less than 60° C. or the heating time is less than 30 minutes, the flakes are brittle and are easily broken. If the water content of the germ portions during heating is not more than 12%, preferably within the range of from 8.5% to 12%, the flakes obtained are supple and strong. If the germ portions have a moisture content more than 12%, the flakes have too much moisture which means that the flakes must be dried. The resulting dried flakes are brittle and the filtration efficiency is not good.

The heated germ portions are flaked with a flaking roller. The flakes preferably have a thickness ranging from 0.3 mm to 0.5 mm. The higher oil-content flakes are light yellow and supple, and are very suitable for the extraction of corn oil. The germ fractions other than the higher oil-content germ fraction are pelletized just like the lower oil-content germ fractions. The pelletizing process is performed by a granulator such as a pelleter or a compression granulator. The shape of the pellets after granulation is not limited, but cylindrical pellets which have a diameter in the range of 3 mm to 8 mm and a length in the range of 4 mm to 10 mm are suitable.

One of the notable features of the present invention is the pelletizing of the lower oil-content germ fraction. By pelletizing the lower oil-content germ fraction, the lower oil-content germ pellets are able to be subjected to the following process with the higher oil-content germ portion. The process of mixing the pelletized lower oil-content germ fraction with the higher oil-content germ fraction can be done before the heating process, before the flaking process or after the flaking process.

The pellets obtained from the lower oil-content germ fraction are subjected to the same process as the higher oil-content germ fraction. The pellets are heated at a temperature in the range of 60° C. to 90° C. for 30 minutes to 60 minutes for softening. The water content of the germ portion during heating should not be more than 12%, preferably in the range of 8.5% to 12%. The heated pellets are flaked with a flaking roller or the like. The flakes are preferably 0.3 mm to 0.5 mm thick. The lower oil-content flakes are supple and are not easily broken during the extraction process, so the miscella can easily be filtered. Threfore, even when the lower oil-content flakes are treated with the higher oil-content flakes, a good quality corn oil is obtained, and the yield of corn oil upon extraction of the mixed flakes is increased by more than about 10% in comparison with the conventional process.

The method employed for extracting corn oil in the present invention is not limited. For example, the flakes can be extracted with n-hexane (1–2 V/W) for 30 minutes to 2 hours at about 60° C.

By the process of the present invention, flakes suitable for the extraction of corn oil are obtained. That is, the flakes are not easily broken during extraction and because of this fact, the operation of the filtration process is relatively easy. Moreover, the quality of the extracted oil is improved, and the yield of extracted corn oil is increased.

Having generally described this invention, a further understanding can be obtained by reference to certain specific examples which are provided herein for purposes of illustration only and are not intended to be limiting unless otherwise specified.

EXAMPLE 1

Maize (oil content: 3.9%) was cleaned with a magnetic separator, a grain separator and a stoner, tempered for 5 hours at room temperature after having added a little amount of water to the maize, milled with an impact-degerminator, and separated with a plan sifter into four fractions in order of particle size as follows: Fraction (I)—the coarse particle fraction on the first screen; Fraction (II) on the second screen; Fraction (III) on the third screen; and Fraction (IV)—the meal fraction on the third screen. Fraction (I) was recycled to the degerminator and milled again. Husks, which contaminated both fractions (II) and (III), were separated from the fractions with an aspirator. A grits fraction was also separated by a gravity table. A larger germ fraction and a smaller germ fraction were independently obtained from two fractions.

The larger germ particles from two fractions were mixed, rolled with a reduction roller, and sieved with a plan sifter. The fraction on the screen was obtained as the higher oil-content germ (oil content: 23.6%, yield: 7%). The fraction which passed through the screen and the germ fractions from other processes were collected as the lower oil content germ fraction (oil content: 14.3%, yield: 7.2%). The lower oil-content germ fraction was pelletized at 60° C. with a pelleter and cooled. And then cylindrical pellets, which were 5 mm in diameter and 6–7 mm in thickness, were prepared.

The higher oil-content germ fraction and the pellets obtained from the lower oil-content germ fraction were mixed, heated for 30 minutes at 90° C. and flaked to a thickness of 0.3 mm to 0.5 mm with a flaking roller. The flakes were extracted with n-hexane (2 V/W) for 2 hours at 60° C., and then most of the extracted flakes were removed by screening with a 60 mesh wire screen. The filtrate obtained contained a small amount of fines. Accordingly, the filtrate was filtered with a No. 4 filter paper. Corn oil was obtained by removal of n-hexane. The quantity of the fines in the flakes, the time in which it took 10 ml of the filtrate to pass through a No. 4 filter paper (6 cm in diameter), the extraction rate of the oils, the acid value of the oils and the residual lipids in the extracted flakes are shown in Table 1.

EXAMPLE 2

The higher oil-content germ fraction obtained in Example 1 was heated for 30 minutes at 70° C. and the lower oil-content pellets obtained in Example 1 were heated for 60 minutes at 90° C. The separate material was mixed and flaked to a thickness of from 0.3 mm to 0.5 mm with a flaking roller. The flakes were extracted and corn oil was prepared by the same method as described in Example 1. The charcteristics of the flakes, the corn oil and the extracted flakes are shown in Table 1.

EXAMPLE 3

The higher oil-content germ fraction obtained in Example 1 was heated for 30 minutes at 70° C. and flaked to a thickness of from 0.3 mm to 0.5 mm with a flaking roller. The pellets obtained in Example 1 were heated for 60 minutes at 90° C. and flaked to a thickness of from 0.3 mm to 0.5 mm with a flaking roller. These flakes were mixed and extracted. Corn oil was prepared by the method described in Example 1. The characteristics of the flakes, the corn oil and the extracted flakes are shown in Table 1.

TABLE 1

| | Example 1 | Example 2 | Example 3 Higher oil content germ | Example 3 Lower oil content germ |
|---|---|---|---|---|
| Fines through a 32 mesh screen (%) | 1.2 | 1.2 | 1.0 | 1.5 |
| Filtering time (sec) | 25 | 25 | 23 | 27 |
| Extraction rate of the oil (%) | 93.6 | 93.6 | 93.6 | |
| Acid value of the oil | 2.0 | 2.0 | 2.0 | |
| Residual lipids in the extracted flakes (%) | 1.5 | 1.5 | 1.5 | |

COMPARATIVE EXAMPLE

For comparision, the following three experiments were conducted:

1. 6 Parts of water were added to 100 parts of cleaned maize for tempering. The maize was then milled with a cone type crusher. A germ fraction (oil content 18.0%) was separated with an aspirator, a gravity separator and a plan sifter, and heated for 30 minutes at 70° C. and flaked by the same method as described in Example 1. The flakes were extracted and corn oil was prepared by the same method described in Example 1. (Comparative example 1).

2. The flakes obtained in Comparative example 1 were pelletized at 60° C. with a pelleter, and cylindrical pellets 5 mm in diameter and 6–7 mm in thickness were prepared. Pellets were extracted and corn oil was prepared by the same method described in Example 1. (Comparative example 2).

3. The germ obtained in Comparative example 1 was pelletized at 60° C. The pellets were heated for 30 minutes at 70° C. and flaked with a flaking roller. The flakes were extracted and corn oil was prepared by the same method as described in Example 1. (Comparative example 3).

The characteristics of the flakes, the pellets and the corn oil are shown in Table 2.

TABLE 2

| | Comparative Example 1 | Comparative Example 2 | Comparative Example 3 |
|---|---|---|---|
| Fines through a 32 mesh screen (%) | 10.6 | 0.5 | 1.5 |
| Filtering time (sec) | 85 | 17 | 26 |
| Extraction rate of the oil (%) | 89.0 | 80.7 | 93.5 |
| Acid value of the oil | 2.0 | 3.0 | 3.5 |
| Residual lipids in the extracted flakes (%) | 3.1 | 4.5 | 1.5 |

COMPARATIVE EXAMPLE 4

Five germ fractions each having a different oil content were prepared. The first was a mixture of higher and lower oil-content germ portions as described in Example 1 (oil content 18.5%). The second was a fraction of larger germ particles before rolling with the reduction roller of Example 1 (oil content 20.8%). The third and fourth fractions were two kinds of higher oil content fractions obtained by rolling and sieving in Example 1 (oil content 22.8% and 23.6%). The fifth fraction was a higher oil content germ after rolling and sieving the 23.6% oil content germ fraction (oil content 26.0%). These germ fractions were each heated for 30 minutes at 70° C. and flaked. The characteristics of the flakes are shown in Table 3.

TABLE 3

| | Characteristics of flakes | |
|---|---|---|
| Germ | Fines through a 32 mesh screen (%) | Mechanical strength* |
| 18.5% oil content of germ | 10.2 | – |
| 20.8% oil content of germ | 4.5 | – |
| 22.3% oil content of germ | 1.5 | + |
| 23.6% oil content of germ | 1.0 | + |
| 26.0% oil content of germ | 0.5 | + |

*+ strong (supple)
– weak (brittle)

The flakes of each germ sample were extracted with n-hexane (2 V/W) for 2 hours at 60°, and then the extracted flakes were removed with a 60 mesh wire screen. The filtrates obtained above contained a small amount of fines. The time for which it took a 100 ml sample of each filtrate to pass through a No. 4 filter paper (6 cm in diameter) was measured as the filtering time. The results are shown in Table 4.

TABLE 4

| Flakes | Filtering time (sec) |
|---|---|
| 18.5% oil content of germ flakes | 85 |
| 20.8% oil content of germ flakes | 63 |
| 22.3% oil content of germ flakes | 27 |
| 23.6 | 23 |
| 26.0 | 21 |

COMPARATIVE EXAMPLE 5

The 23.6% oil content germ fraction obtained in Comparative example 4 was heated under the conditions shown in Table 1, and flaked to a thickness of from 0.3 mm to 0.5 mm with a flaking roller. The effects of the heating on the characteristics of the flakes are shown in Table 5.

TABLE 5

| | Heating conditions | | Characteristics of flakes | |
|---|---|---|---|---|
| Moisture of germ | Temp. (°C.) | Time (min.) | Fines through a 32 mesh screen (%) | Mechanical strength* |
| 8.5 | Room Temp. | 0 | 3.2 | – |
| | 50 | 60 | 2.8 | – |
| | 70 | 20 | 2.5 | – |
| | 70 | 30 | 1.0 | + |
| | 70 | 60 | 1.0 | + |
| | 70 | 90 | 2.3 | – |
| | 90 | 30 | 1.2 | – |
| 15 | 70 | 60 | 1.3 | brittle when dried |

*+ strong (supple)
– weak (brittle)

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A process for producing corn oil, which comprises: (a) obtaining germ by the dry milling of maize; (b) separating the higher oil-content germ having an oil content of not less than 22% by weight from the lower oil-content germ; (c) pelletizing said lower oil-content germ; (d) mixing said pelletized lower oil-content germ with said higher oil-content germ; (e) heating and flaking said mixed germ fractions, thereby obtaining a flaked product, wherein the temperature of the heating process is in the range of from 60° C. to 90° C.; and (f) contacting said flaked product with an organic solvent to extract corn oil therefrom.

2. A process for producing corn oil, which comprises:
(a) obtaining germ by the dry milling of maize;
(b) separating the higher oil-content germ having an oil content of not less than 22% by weight from the lower oil-content germ;
(c) pelletizing and heating said lower oil-content germ to give a heated lower oil-content germ, wherein the temperature of the heating process is in the range of from 60° C. to 90° C.;
(d) heating said higher oil-content germ to give a heated higher oil-content germ, wherein the temperature of the heating process is in the range of from 60° C. to 90° C.;

(e) mixing said heated lower oil-content germ with the heated higher oil-content germ to give mixed germ fractions;

(f) flaking said mixed germ fractions to give a flaked product; and (g) contacting said flaked product with an organic solvent to extract corn oil therefrom.

3. A process for producing corn oil, which comprises:

(a) obtaining germ by the dry milling of maize;

(b) separating the higher oil-content germ having an oil-content of not less than 22% by weight from the lower oil-content germ;

(c) pelletizing, heating and flaking said lower oil-content germ, thereby obtaining lower oil-content flakes, wherein the temperature of the heating process is in the range of from 60° C. to 90° C.;

(d) heating and flaking said higher oil-content germ, thereby obtaining higher oil-content flakes, wherein the temperature of the heating process is in the range of from 60° C. to 90° C.; and (e) mixing said lower oil-content flakes with said higher oil-content flakes to give mixed flakes and contacting said mixed flakes with an organic solvent to extract corn oil therefrom.

4. The process of claim 1, 2, or 3, wherein the water content of said germ fractions during heating is not more than 12%.

5. The process of claim 1, 2, or 3, wherein said flaked germ particles are in a thickness range of 0.3 mm to 0.5 mm.

6. The process of claim 1, 2, or 3, wherein the temperature of the heating process is in the range of from 60° C. to 90° C. for 30 minutes to 60 minutes.

* * * * *